US009375108B2

(12) United States Patent
Schwarz et al.

(10) Patent No.: US 9,375,108 B2
(45) Date of Patent: Jun. 28, 2016

(54) DEVICE FOR THE ORAL APPLICATION OF A SUBSTANCE

(75) Inventors: Franz Xaver Schwarz, Worgl (AT); Thomas Jakob, Selb (DE); Robert Reichenberger, Wunsiedel (DE)

(73) Assignee: SANDOZ AG, Basel (CH)

( * ) Notice: Subject to any disclaimer, the term of this patent is extended or adjusted under 35 U.S.C. 154(b) by 1772 days.

(21) Appl. No.: 12/595,739

(22) PCT Filed: Apr. 10, 2008

(86) PCT No.: PCT/EP2008/002820

§ 371 (c)(1),
(2), (4) Date: Oct. 13, 2009

(87) PCT Pub. No.: WO2008/122438

PCT Pub. Date: Oct. 16, 2008

(65) Prior Publication Data

US 2010/0063473 A1 Mar. 11, 2010

Related U.S. Application Data

(60) Provisional application No. 60/951,266, filed on Jul. 23, 2007.

(30) Foreign Application Priority Data

Apr. 10, 2007 (EP) ..... 07105845
Jul. 5, 2007 (DE) ..... 10 2007 031 368

(51) Int. Cl.
*A47G 21/18* (2006.01)
*A61J 7/00* (2006.01)

(52) U.S. Cl.
CPC ..... *A47G 21/183* (2013.01); *A61J 7/0053* (2013.01)

(58) Field of Classification Search
CPC ..... A47G 21/183; A47G 2400/027; A47G 21/185; A47G 21/184; A47G 21/18; A61J 15/00; A61J 7/0053; A61J 7/0038; A61J 9/00; A61M 5/31596; A61M 5/284; A61M 2005/31598; A61M 2205/076
USPC ..... 604/514, 218, 226, 231–232, 236–238
See application file for complete search history.

(56) References Cited

U.S. PATENT DOCUMENTS 1,272,742 A * 7/1918 Weguelin et al. ..... 604/82
3,572,337 A 3/1971 Schunk (Continued)

FOREIGN PATENT DOCUMENTS

DE 29723499 9/1998
EP 0840591 A1 5/1998

(Continued)

*Primary Examiner* — Nathan R Price
*Assistant Examiner* — Weng Lee
(74) *Attorney, Agent, or Firm* — Jeffrey S. Melcher; Manelli Selter PLLC

(57) ABSTRACT

A device for oral application of a substance, comprising an inner tube surrounding a first volume an outer tube surrounding a second volume, the second volume comprising a cavity section adjoining an inlet opening of the outer tube being adapted for containing the substance, a separation area arranged in the second volume, the separation area adjoining the cavity section and the first volume, and a selective connecting passage between the cavity section and a pressure compensation space to selectively enable a flow of the substance from the cavity section though the first volume. A kit-of-parts, comprises the inventive device a predefined amount of a substance being contained in a receptacle or the cavity section, and instructions for the use of the substance. Methods for filling the inventive device as well as to a method for oral application using the inventive device are provided.

7 Claims, 8 Drawing Sheets

(56) References Cited

U.S. PATENT DOCUMENTS

| | | | | | |
|---|---|---|---|---|---|
| 3,661,265 | A | * | 5/1972 | Greenspan | 210/359 |
| 3,870,639 | A | * | 3/1975 | Moore | B01L 3/5021 210/359 |
| 4,784,641 | A | | 11/1988 | White | |
| 4,792,333 | A | | 12/1988 | Kidder | |
| 4,981,468 | A | | 1/1991 | Benefiel et al. | |
| 5,244,122 | A | | 9/1993 | Botts | |
| 5,300,024 | A | | 4/1994 | Yang | |
| 5,338,294 | A | * | 8/1994 | Blake, III | A61M 1/0062 604/190 |
| 5,431,290 | A | | 7/1995 | Vinciguerra | |
| 5,431,680 | A | | 7/1995 | Jones | |
| 5,662,268 | A | | 9/1997 | Katzenberger | |
| 5,718,681 | A | | 2/1998 | Manning | |
| 5,779,668 | A | * | 7/1998 | Grabenkort | 604/89 |
| 5,780,058 | A | * | 7/1998 | Wong | A47G 21/183 424/438 |
| 5,824,012 | A | | 10/1998 | Burchett et al. | |
| 6,126,679 | A | | 10/2000 | Botts | |
| 6,981,962 | B1 | | 1/2006 | Lenkersdorf | |
| 2003/0024575 | A1 | * | 2/2003 | Williamson et al. | 137/510 |
| 2007/0262164 | A1 | | 11/2007 | Gelfand | |

FOREIGN PATENT DOCUMENTS

| | | | |
|---|---|---|---|
| FR | 1092894 | A | 4/1955 |
| FR | 1121192 | A | 7/1956 |
| FR | 2082128 | A5 | 12/1971 |
| WO | 96/34681 | A1 | 11/1996 |
| WO | 9703634 | A1 | 2/1997 |
| WO | 03079957 | A1 | 10/2003 |
| WO | 2005025485 | A1 | 3/2005 |
| WO | 2006131328 | A1 | 12/2006 |

* cited by examiner

DEVICE FOR THE ORAL APPLICATION OF A SUBSTANCE

CROSS REFERENCE TO RELATED APPLICATIONS

The present application is the U.S. National Phase of International Patent Application Serial No. PCT/EP2008/002820, filed on Apr. 10, 2008, which claims the benefit of U.S. Provisional Patent Application Ser. No. 60/951,266, filed on Jul. 23, 2007, German Patent Application Serial No. 10 2007 031 368.5, filed on Jul. 5, 2007, and European Patent Application Serial No. 07105845.7, filed on. Apr. 10, 2007, all of which are hereby incorporated by reference in their entireties.

TECHNICAL FIELD OF THE INVENTION

The present invention relates to oral application of substances, a device for the oral application of substances, a dosing device for administering doses of a free-flowing composition together with a free-flowing carrier medium, a one-way valve to be applied in such a device and a method for filling the device.

TECHNICAL BACKGROUND

Oral administration of pharmaceutical formulations comprising an active pharmaceutical ingredient with an unpleasant taste remains a technical challenge, in particular, children show a very bad compliance towards bitter formulations. Taste masked formulations have been developed to improve patient compliance However, taste-masked formulations typically only work well for solid dosage forms. If liquid drug mixtures are used or in the case of high doses, i.e. large amounts substance to be swallowed, taste-masked formulations typically don't work that well.

In EP 0 840 591 B1, a delivery system for the oral application of an active agent formulation is described, in which a formulation chamber comprises the agent formulation retained by a retainer. For oral application, one end of the container is immersed in liquid, while the other end is applied to the patient's mouth. Comparable to the use of a straw, the patient draws the drink into the container and the retainer allows a fluid to flow through the container, while the agent formulation is carried away together with the drink flowing through the straw. For both, filling of the container with the formulation to be administered and emptying of the container by the patient, the same end is used. Further, the retainer moves through the container together with the flow entering into the container. Both ends of the container are crimped for preventing the release of the retainer.

For consummation, a cap has to be removed from one end such that the active agent in the container can be sucked through the opened end. In particular in case of incorrect use, for example by tilting or shaking the container, at least a part of the active agent can be lost. In addition, the location of the retainer is used as an indicator if the agent has been consumed completely, such that the device has to be thrown away after use. Moreover, the amount of formulation to be administered is determined by the initial filling step and cannot be in any way adapted by the patient according to his or her individual characteristics.

FR 1 092 894 A discloses to feed a substance which is disposed in an annular chamber between an inner tube and an outer tube via conduits to a central bore. In this central bore, the substance can be nebulised with pressureised air which is fed from above by a pump actuation via a check valve.

FR 1 121 192 A discloses a dosing device having a one-way valve for portioned administering of a substance contained in the dose device. In the stand-up position of the device, a given dose portion of a liquid accumulates in a chamber of an inner container. After turning around the device, the one-way valve closes by abutment of an annular wall of the inner container to an annular receptacle. The does portion of the liquid substance then can be extracted via a suction opening in a mouth piece.

It is an object of the invention to provide a mechanism for oral application of a substance with enhanced handling properties and which in particular is suitable for multiple use.

SUMMARY OF THE INVENTION

This object is solved by the devices of claims 1 and 18, the kit-of-parts of claim 26, the method of claim 27 as well as the method of claim 30.

The underlying concept of the invention is to use an assembly of an inner tube arranged at least partly in an outer tube. A separation area in the outer tube and the separation area define a cavity section, in which a substance, in particular a liquid pharmaceutical formulation, can be contained. The flow of the substance into the inner tube is controlled by a selective connection passage. The outer tube comprises or is connected with an inlet opening, the inlet opening having a fluid connection with the cavity section to enable a pressure compensation for the volume, which corresponds to the substance flowing into the inner tube. For selecting, activating or adjusting the flow of substance into the inner tube, a fluid connection between cavity section and inner tube and/or a fluid connection into the cavity section is controlled by the selective connection passage. According to the invention, the volume of substance flowing into the inner tube is replaced or pressure compensated by supplying a drinkable liquid, which flows into the cavity section to replace the volume of substance removed from the cavity section. Therefore the substance, for example a liquid pharmaceutical formulation, is delivered through the inner tube into a person's mouth followed by the volume replacing drinkable liquid which can be adapted to extinguish or relieve any unpleasant taste the substance, such as the liquid pharmaceutical formulation, might have had.

In this way, the inner tube, together with the cavity section, forms a conduct through which the substance and, subsequently, a drink can be selectively delivered for oral application. The cavity section can be emptied through the inner tube an one end of the cavity section and can be filled or refilled at the opposite end, adjacent to the inlet opening. The cavity section can be filled by drawing the separation area away from the inlet opening. An aspect of the selective connection passage is to provide a controlled flow of substance out of the cavity section. Another aspect of the selective connection passage is to control the pressure compensation linked with the flow of substance. Another aspect of the selective connection passage is to retain the substance inside the cavity section. According to an alternative, another aspect of the selective connection passage is to deliver a drinkable liquid or a gas into the cavity section. Another aspect of the selective connection passage is to enable the filling or refilling the cavity section. The separation area shows similar aspects of the invention, for example to retain the substance and to controllably allow a flow of substance from the cavity section or into the cavity section. Another aspect of the separation area is to variably define the volume of the cavity section, i.e. to reduce the volume for emptying the cavity section by moving the separation area towards one end of the outer tube, and to increase the volume for refilling substance into the cavity section by moving the separation area towards the opposite end of the outer tube. The separation area can be combined with the selective connection passage. In combination or alternatively, the separation area can be combined with the inlet opening of the outer tube.

Advantageously, the outer tube comprises the inlet opening, through which the substance can be filled into the cavity section at an upper end of the outer tube. The inlet opening can also be an additional, sealable passage extending through the outer tube at the cavity section. The inlet opening can be formed together with the outer tube as one piece, can be glued to the outer tube or can be an additional element that can be attached to and removed from the outer tube, e.g. by a press fit connection, by a screw fitting or by a similar connection. Preferably the inlet opening and the outer tube are both part of the same piece.

The cavity section is a part of the second volume surrounded by the outer tube. The second volume is defined by the inner surface of the outer tube and the respective two ends of the outer tube. The cavity section, i.e. a section comprising an upper end of the second volume, adjoins to the inlet opening. Since the inlet opening can also define an inner volume, this inner volume forms or adjoins the upper end of the second volume.

At the outer surface of the outer tube and/or at the inner tube, a first grip section can be arranged in or protruding from the outer tube and/or outer tube, respectively. In one embodiment of the outer tube, at or adjacent to the opposite end of the upper end, i.e. the lower end of the outer tube, stoppers can be provided extending towards the second volume. The outer tube the has a constant inner cross section, at least along the cavity section or, preferably, from the upper end to the bottom end. Preferable, the inner tube has a constant inner cross section. In one embodiment, the outer and the inner surface of the outer tube and/or of the inner tube is cylindrical, preferably with a circular, ovoid or polygonal cross section. Further, the outer tube or the inner tube can be formed of a continuous wall with a constant thickness.

The inner surface of the inner tube extending from an upper end to a lower end located at the respective ends of the inner tube define a second volume. The upper end of the inner tube reaches into or directly adjoins to the cavity section such that the substance contained in the cavity section can flow through the first volume to the lower end of the inner tube. The upper end of the inner tube and the outer tube are arranged such that the flow from the cavity section is directed exclusively into the first volume and cannot reach other parts of the second volume other than the cavity section.

A separation area, together with the upper end of the inner tube delimits the cavity section, i.e. the section in which the substance is stored, in one direction. Alternatively, the separation area, the upper end of the inner tube as well as a part of the inner tube extending into the cavity section for a continuous area for delimiting the cavity section in one direction. In one embodiment, the separation area sealingly adjoins to the inner surface of the outer tube, the separation area defining a sealing ring between the outer surface of the inner tube and the inner surface of the outer tube. The circumferential rim or border abutting to or contacting the inner surface of the outer tube can be formed of an elastic sealing material. In another embodiment, the outer diameter of the inner tube corresponds to the inner diameter of the outer tube, such that no further elements like a sealing ring are necessary. In this way, the upper end of the inner tube, together with the inner surface of the outer tube along the cavity section and the inlet opening and/or the upper end of the outer tube together define the cavity section of the second volume. In this embodiment, no sealing materials are necessary. Accordingly, the separation area equals to the upper end of the inner tube.

According to the invention, the selective connecting passage selectively provides a pressure compensation which leads to a flow of the substance through the inner tube to the lower end of the inner tube. Mainly, there are two concepts relating to the structure of the selective connecting passage. According to the first concept, the selective connecting passage is provided in the inner tube or is located at the upper or at the lower end of the inner tube, preferably it is located at the lower end. In this way, a pressure compensation through the selective connecting passage is identical to the flow of a substance from the cavity section into the first volume, i.e. into the inner tube. According to the invention, this is realized by arranging a valve element or a breakable membrane in the inner tube or at one end of the inner tube, such that flow of substance is enabled, if the valve or the membrane enables a flow rate greater than zero through the inner tube. The valve or the membrane can also be referred to as flow control element. The flow control element can further comprise elements or characteristics of a throttle.

The second concept for the selective connecting passage is to arrange the selective connecting passage between the cavity section and the environmental space, for example at the upper end of the outer tube or in or at the inlet opening. If the pressure is balanced, the substance stays inside the cavity section since any movement of the substance towards the first volume would induce a low pressure pulling the substance back towards the upper end of the outer tube or towards the inlet opening. Therefore, in order to compensate a pressure difference, the selective connecting passage would allow an external fluid, a liquid, e.g. a drinkable liquid, a gas, e.g. ambient air to flow through the inlet opening and/or through the upper end of the outer tube into the cavity section. This would enable the substance in the cavity section to escape into the first volume, i.e. into the inner tube and to be supplied to the lower end of the inner tube. According to the second concept, the selective connecting passage indirectly enables a flow of substance from the cavity section through the inner tube by allowing a pressure compensation with the external fluid.

Summarized, if the selecting connecting passage is located between the cavity section and the lower end of the inner tube, the substance directly flows through the selective connecting passage. The first concept is therefore based on the direct control of the substance flow, i.e. the flow controlled by the controllable connection passage is identical with the flow of substance into the inner tube. In the first concept, a flow control element of the selective connecting passage is preferably an element of the separation area. According to the second concept, the selective connecting passage enables pressure compensation by providing a controlled flow of external fluid into the cavity section. The flow of substance is a result of the controlled pressure compensation. In the second concept, the substance is not directed through the selective connecting passage. According to the second concept, a flow control element of the selective connecting passage is preferably not an element of the separation area but is arranged in or nearby the inlet passage or extends though the outer tube, preferably at the cavity section.

A third concept regarding the selective connecting passage combines the first and the second concept and comprises two elements for controlling the flow of the substance. One flow control element directly controls the flow of the substance from the cavity section into the second volume and can be realized by a valve or a pressure-breakable membrane in the inner tube or at one of the ends of the inner tubes. Therefore, the first flow control element corresponds to the first concept. The second flow control element is located between the cavity section and an external fluid, for example at the upper end of the outer tube or at the inlet opening or extending through the inlet opening or through the second tube in the cavity section. Thus, corresponding to the second concept, the second flow control element indirectly controls the flow of substance into the inner tube by controlling the pressure compensation between the cavity section and the external fluid.

In the first and the second concept, substance might slowly leak out of the cavity section through the respective passage between the cavity section and the ambient atmosphere which is not blocked by a selective connecting passage. Therefore, the diameters preferably small in comparison to the length of the respective tubes and/or the diameter of the cavity section or the inner tube has to be dimensioned such that surface tension, viscosity and vacuum pressures force the substance to stay inside the cavity section. According to the third concept, no leakage is possible. Alternatively, if the device comprises only one selective connecting passage, directly or indirectly controlling the flow of the substance, the passage from the cavity section to outside, which is not the selective connecting passage, could be closed with a filter or a membrane which allows a flow of external liquid or a flow of the substance only, if there is the pressure difference exceeding a non-negative threshold.

The selective connecting passage or passages can be realized by flow control element like a non-return valve, an actuatable valve, and/or a pressure-breakable separation membrane or similar elements. These elements can be combined, for example a non-return valve can also have an actuation such that the non-return valve enables a flow only upon actuation. The selective connecting passage can be realized by non-return valve in the inner tube or at one end of the inner tube enabling a flow from the cavity section towards the lower end of the inner tube, only if the pressure of the volume between the selective connecting passage and the lower end of the inner tube is less than the pressure inside the cavity section. In the case that the selective connecting passage is arranged between the cavity section and the surrounding matter, it can be realized as a non-return valve enabling a flow into the cavity section only, if the pressure in the cavity section is lower than the pressure of the surrounding matter.

Further, a membrane or a closing lid could be used for hygienic reasons, which is not pressure-breakable but can be removed just before usage of the device.

In one embodiment, a flow control element in form of a valve or a membrane is arranged at the upper end of the inner tube and separates the cavity section of the second volume from the first volume. If a valve is used which can be actuated, this valve can be located nearby the lower end of the inner tube at a lower section extending from the outer tube. Alternatively, a flow control element can be located at the inlet opening or upper end of the outer tube. In this way, an actuation lever or an actuation button can be easily accessed from outside. In one embodiment, an actuation element is provided in the grip section of the inner tube or in the grip section of the outer tube.

If valves are used, these valves can control a flow such that a minimum pressure difference has to be exceeded to allow a flow. In this way, the flow suddenly starts with a high velocity, if the pressure difference is exceeded, such that the substance flows into the mouth of the patient with the high velocity. In this way, the substance can easily be swallowed. Preferably, the inlet opening or any other passage allowing a pressure compensation of the cavity section with the ambient is immersed in a drink, for example juice, such that the drink immediately follows the substance. In this way, the substance reaches the tongue only for a short moment, immediately followed by the drink, such that the patient only experiences the taste of the juice and the taste of the substance is covered. Preferably, the inlet opening or a corresponding opening is immersed into a drink and the pressure in the cavity section is compensated by the drink or any other liquid flowing into the cavity section, instead of external gaseous fluid. Advantageously, the external fluid flowing into the cavity section and following the substance has similar flowing characteristics as the substance and the flow rate through the inner tube is more constant and more comfortable for the user.

According to one embodiment, at least a part of the substance, e.g. a layer of the substance located adjacent to the upper end of the cavity section has a high viscosity acting as a plug which can be removed by drawing the substance corresponding to the layer of substance into the inner tube. In this way, the layer of substance, alone or in combination with the upper end of the inner tube forms a flow control element or a selective connection passage. Such a viscous part of the substance may form a breakable layer blocking the flow between inlet opening and inner tube and is preferably located at or near the inlet section, in the center of the cavity section or at the separation area and preferably is extending radially across the entire cross section area of the second volume. Such a plug formed of viscous and/or elastic substance or material can be used as the sole selective connection passage or flow control element of the device or can be combined with additional a selective connection passage or an additional flow control element or a plurality thereof.

Preferably, the user can activate the flow of the substance by exceeding a pressure difference between the cavity section and the first volume and/or by manually actuating the flow control elements. If both elements are combined, the start of the flow can be selected while a certain minimum flow velocity is guaranteed.

According to another aspect of the invention, the separation area is movable relative to the outer tube, such that the volume provided by the cavity section can be reduced or increased. If the separation area is moved from the inlet opening towards the lower end of the outer tube, the resulting flow can be used to supply an external substance or other flowable matter from outside through the inlet opening into the cavity section. In this way, the device is fillable and refillable. In one embodiment, a first part of the outer tube and/or the inlet opening is in a removable connection with a second part of the outer tube or with the outer tube, respectively.

Preferably, the separation area is attached to the inner tube or is at least partly formed of the inner tube. If a part of the separation area is formed of a member which is not part of the inner tube, this member can be attached to the inner tube by a press-fit, by gluing, by a screw connection or by any other adequate mechanism.

In order to provide that the separation area closes the cavity section and the movement of the separation area relative to the outer tube, the outer tube advantageously has a constant cross-section, at least in the cavity section, or, additionally, between the upper end and the lower end of the outer tube. In one embodiment, stoppers are provided abutting to the bottom of the outer tube which avoid any unintentional removal of the inner tube from the outer tube. Preferably, these stoppers or additional guiding elements connected with the outer tube are in sliding contact with the outer surface of the inner tube for providing a guidance for the inner tube. According to one embodiment, the stoppers are formed by a small ring extending from the inner surface of the outer tube towards the center of the outer tube, such that the inner tube can be removed from the outer tube, if the inner tube is pulled out of the outer tube with a force extending a threshold necessary for passing the small ring. In this way, the device can be cleaned after and before usage.

According to another embodiment of the invention, the upper end of the outer tube comprises or is connected to an inlet opening with at least one tapering section such that unintentional leakage of substance through the inlet opening is avoided by the small cross section of the inlet opening.

According to another embodiment the inner tube is at least as long as the outer tube such that the lower end of the inner tube extends from the outer tube, if the separation area is close to the inlet opening and can be easily moved by manually pulling the lower end of the inner tube. For better handling, a first grip section is provided at least partly circumferential around the section of the inner tube, preferably nearby or at the lower end of the inner tube. Further, a mouthpiece can be attached to or arranged at the lower end of the inner tube, preferably with a tapered section which allows to apply the end of the inner tube to the mouth without touching the first grip section. Alternatively or in combination therewith, a second grip section is formed at the outer surface of the outer tube, such that the inner tube can be moved relative to the outer tube by pulling the first grip section apart from the second grip section.

Advantageously, the outer tube comprises at least a section of translucent or transparent material, preferably at least a window of this material extending along the cavity section from the upper end of the outer tube towards the lower end of the outer tube. In another embodiment, the cavity section or the complete outer tube is formed of translucent or transparent material which allows an easy optical assessment of the substance level inside the cavity section. Preferably, filling marks are provided at least along the cavity section, for example lines, equidistantly distributed from the upper end of the outer tube towards the lower end of the outer tube at least along the cavity section or along the complete length of the outer tube. These lines can be combined with symbols, signs, numbers or alphanumeric labels which indicate a certain dose (corresponding to a particular volume of substance to be administered) or a quantity of substance if the level of the substance corresponds to the respective line or mark.

Preferably, the substance is a liquid, like a liquid pharmaceutical formulation, but can also be a powder or particles or a solid or a liquid with a high viscosity which solves into a stream of passing liquid entering the cavity section through the inlet opening or forms a suspension together with the liquid flowing through the inlet opening, the cavity section or the inner tube, or a combination thereof. Therefore, also covered particles can be used which deliver the drug contained therein only after the removal of the coating leading to a prolonged or delayed release of the drug or active agent.

Preferably, the substance to be delivered through the inner tube refers to an agent, drug, compound. The term substance refers to an agent, drug, compound, composition of matter or mixture thereof which provides some pharmacologic, often beneficial, effect. This includes foods, food supplements, nutrients, drugs, vitamins, and other beneficial agents. As used herein, the substance can include any physiologically or pharmacologically active substance that produces a localized or systemic effect in a patient. The substance to be administered is preferably a liquid pharmaceutical formulation comprising at least one active pharmaceutical ingredient, for example an antibiotic, antiviral agent, anepileptic, analgesic, anti-inflammatory agent and bronchodilator, and may be an inorganic or organic compound, including, without limitation, drugs which act on the peripheral nerves, adrenergic receptors, cholinergic receptors, the skeletal muscles, the cardiovascular system, smooth muscles, the blood circulatory system, synoptic sites, neuroeffector junctional sites, endocrine and hormone systems, the immunological system, the reproductive system, the skeletal system, autacoid systems, the alimentary and excretory systems, the histamine system and the central nervous system. Suitable agents comprised by the substance may be selected from, for example, polysaccharides, steroids, hypnotics and sedatives, psychic energizers, tranquilizers, anticonvulsants, muscle relaxants, antiparkinson agents, analgesics, anti-inflammatories, muscle contractants, antimicrobials, antimalarials, hormonal agents including contraceptives, sympathomimetics, polypeptides and proteins capable of eliciting physiological effects, diuretics, lipid regulating agents, antiandrogenic agents, antiparasitics, neoplastics, antineoplastics, hypoglycemics, nutritional agents and supplements, growth supplements, fats, ophthalmics, antienteritis agents, electrolytes and diagnostic agents.

Examples of active agents comprised by the substance and useful in this invention include prochlorperazine edisylate, ferrous sulfate, aminocaproic acid, mecamylamine hydrochloride, procainamide hydrochloride, amphetamine sulfate, methamphetamine hydrochloride, benzphetamine hydrochloride, isoproterenol sulfate, phenmetrazine hydrochloride, bethanechol chloride, methacholine chloride, pilocarpine hydrochloride, atropine sulfate, scopolamine bromide, isopropamide iodide, tridihexethyl chloride, phenformin hydrochloride, methylphenidate hydrochloride, theophylline cholinate, cephalexin hydrochloride, diphenidol, meclizine hydrochloride, prochlorperazine maleate, phenoxybenzamine, thiethylperazine maleate, anisindione, diphenadione erythrityl tetranitrate, digoxin, isoflurophate, acetazolamide, methazolamide, bendroflumethiazide, chlorpropamide, tolazamide, chlormadinone acetate, phenaglycodol, allopurinol, aluminum aspirin, methotrexate, acetyl sulfisoxazole, hydrocortisone, hydrocorticosterone acetate, cortisone acetate, dexamethasone and its derivatives such as betamethasone, triamcinolone, methyltestosterone, 17b-estradiol, ethinyl estradiol, ethinyl estradiol 3-methyl ether, prednisolone, 17-b-hydroxyprogesterone acetate, 19-norprogesterone, norgestrel, norethindrone, norethisterone, norethiederone, progesterone, norgesterone, norethynodrel, aspirin, acetaminophen, indomethacin, naproxen, fenoprofen, sulindac, indoprofen, nitroglycerin, isosorbide dinitrate, propranolol, timolol, atenolol, alprenolol, cimetidine, clonidine, imipramine, levodopa, chlorpromazine, methyldopa, dihydroxyphenylalanine, calcium gluconate, ketoprofen, ibuprofen, cephalexin, erythromycin, haloperidol, zomepirac, ferrous lactate, vincamine, phenoxybenzamine, diltiazem, milrinone, captropril, mandol, quanbenz, hydrochlorothiazide, ranitidine, flurbiprofen, fenbufen, fluprofen, tolmetin, alclofenac, mefenamic, flufenamic, difuninal, nimodipine, nitrendipine, nisoldipine, nicardipine, felodipine, lidoflazine, tiapamil, gallopamil, amlodipine, mioflazine, lisinopril, enalapril, captopril, ramipril, enalaprilat, famotidine, nizatidine, sucralfate, etintidine, tetratolol, minoxidil, chlordiazepoxide, diazepam, amitriptyline, and imipramine. Preferred active agents are antibiotics like penicillins, cephalosporins, makrolides and carbapenems. Further examples of the substance comprise proteins and peptides which include, but are not limited to, insulin, colchicine, glucagon, thyroid stimulating hormone, parathyroid and pituitary hormones, calcitonin, renino, prolactin, corticotrophin, thyrotropic hormone, follicle stimulating hormone, chorionic gonadotropin, gonadotropin releasing hormone, bovine somatotropin, porcine somatropin, oxytocin, vasopressin, prolactin, somatostatin, lypressin, pancreozymin and luteinizing hormone.

It is to be understood that more than one active agent may be incorporated into the active agent formulation comprised by the substance located in a device according to the invention, and that the use of the term "agent" in no way excludes the use of two or more such agents, for example combinations like amoxicillin/clavulanic acid, piperazillin/tazobactam, ampicillin/sulbactam.

The agents can be in various forms, such as soluble and insoluble charged or uncharged molecules, components of molecular complexes or nonirritating, pharmacologically acceptable salts.

The amount of active agent contained in the substance and employed in the device will be that amount necessary to deliver a therapeutically effective amount of the agent to achieve the desired result.

In the substance, the amount of active agent depends on the particular agent, the severity of the condition, and the desired therapeutic effect. In particular, the device is advantageous for applying active agents that must be delivered in fairly large doses of from about 100 mg to 5000 mg, usually in the range of from about 250 mg to about 2500 mg. However, since the devices may also be useful in pediatric patients, doses in the ranges of 25 to 250 mg are also contemplated herein. Thus, in an exemplary group of embodiments, the amount of substance, e.g. substance containing an amount of active agent set out above, in the cavity section is preferably at least 1 ml and at 50 ml at the maximum. In another exemplary group, this volume is at least 2 ml and 25 ml at the maximum.

Thus, according to the invention the device can be delivered with a certain, predefined amount of substance, for example equivalent to a certain daily dose. Further, the device can, be delivered with the substance contained in the cavity section. It is, however, preferred that the substance, in particular the liquid pharmaceutical formulation, is contained in a separate receptacle or bottle and has to be pulled into the cavity section by moving the inner tube relative to the outer tube towards the lower end of the outer tube. Therefore, in a preferred embodiment, the invention relates to a kit of parts comprising the device of the invention, and a receptacle filled with a liquid pharmaceutical formulation, wherein preferably an opening of the receptacle is adjusted in such a manner as to provide a fit for the inlet opening of the device.

This kit of parts is particularly suitable whenever administration to patient groups which have difficulties with swallowing tablets and/or capsules is intended, for example to children or elderly patients. Thus, in a preferred embodiment, the liquid pharmaceutical formulation is preferably a pediatric and/or geriatric formulation.

The receptacle filled with a liquid pharmaceutical formulation preferably comprises from one to 100 unit doses of the liquid pharmaceutical formulation to be administered, preferably from 5 to 50. Preferably, the instructions for use in addition indicate the volume of the unit dose to be administered. A further advantage of the device of the invention, and in particular of the kit of parts of the invention, is that it enables a flexible treatment regime, simply in that the patient can vary the amount of substance which he sucks into the device according to his current needs or to the instructions for use, which might foresee a variable amount to be administered. This is in contrast to the delivery device of EP 0 840 591 B1, where fixed predetermined amounts of pharmaceutical formulation are pre-filled into the device and cannot be changed after filling.

Preferably, the device is delivered together with instructions for use of the substance and/or for instructions for use of the device together forming a kit-of-parts ready for oral treatment of a disease. In one embodiment, the instructions comprise information about the volume of substance, which is to be filled into the device. Advantageously, the receptacle comprises or is connected to an adapter for safely connecting the device to the receptacle when filling or refilling the device. Preferably, the adapter comprises a section fitting into or onto a part of the inlet section or a refill opening in the outer tube.

Further, the concept underlying the invention is implemented by a method for filling the device described above, including the steps of: arranging the separation area near to the inlet opening, that is to provide a minimum or zero volume in the cavity section. Further, the separation area is pulled away from the inlet opening, for example by pulling the inner tube out of the outer tube which increases the volume of the cavity section which is filled by the external fluid present at the inlet opening, that is the external substance supplied at the inlet opening. In this way, the device can be filled for a first time or can be refilled after the separation area has been pushed close to the inlet opening. In order to reduce or increase the volume in the cavity section between the separation area and the inlet opening, the inner tube and the outer tube are movable relative to each other as it is known from a syringe. If the inlet opening or a part of the outer tube can be attachably removed, also viscous or solid substances can be filled in the cavity section, which are transported into the inner tube the flow of external fluid through the cavity section.

After filling the device, the substance in the cavity section is, transported through the inner tube. In this view the invention fundamentally differs from a syringe since a syringe does not have an element comparable to the inner tube. As a second difference, there is no element in a syringe comparable to the selective collecting passage or a flow control element.

With the method described above, the amount of substance can be exactly defined by the movements of the inner tubes relative to the outer tube, i.e. the movement of the separation area from the inlet opening for providing an exact dose of active agent contained in the substance. In order to produce a product which can be stored and delivered, the inlet opening is sealed with a removable sealing cap, plug or sealing lid which allows easy handling. Before the device is used, the sealing cap or the sealing lid is removed.

The concept underlying the invention is further realized by a method for the oral application using the device as described above. After having filled the device with a substance, the inlet opening of the device is immersed in drinkable liquid (or any other consumable fluid) and the substance as well as the drinkable liquid is drawn through the inner tube, i.e. through the first volume according to the flow enabled by the selective connecting passage. As described above, the selective connecting passage is actuated by the low pressure generated by drawing, by manually activating a flow control element or by a combination thereof.

In this way, actuating the selective connecting passage or a flow control element, comprises providing a pressure in the first volume which is lower than the pressure in the cavity section. Alternatively or in combination therewith, the flow control element is a release element providing a flow if activated. The flow control element directly or indirectly controls the flow through the selective connecting passage.

For refilling the device, the cavity section has to be reduced by pushing the separation area to the inlet opening. If the selective connecting passage enables the flow between the cavity section and the surrounding matter, for example in the case of a flow control element connected at the inlet opening between the cavity section and the surrounding matter, a flow has to be enabled from the cavity section through the inlet opening for emptying the cavity section. If the flow control element has the characteristics of a non-return valve which is used to enable a flow from the cavity section to the inner tube, this flow control element has to be manipulated for allowing a flow through the inlet opening in the opposite direction. This can be implemented by temporarily removing the flow control element from the inlet opening or by adding a second element which temporarily allows the flow of matter from the cavity section to outside, for example by a whole which can be opened for emptying the device and which can be closed before or after a substance is refilled into the cavity section. In another embodiment, the matter contained in the cavity section after the usage of the device can flow through the inner tube, when the inner tube is moved towards the inlet opening.

The inner tube, the outer tube, in particular the cavity section, any lids caps, plugs, the inlet opening, the mouth piece, the selective connecting passage, the flow control element(s) and/or separation area can be formed of any suitable materials. Such materials comprise paper, plastic such as propylenelstyrene copolymers, polyproylene, high density polyethylene, low density polyethylene and the like. The inner tube and/or the outer tube can have an inner diameter of between about 3 and 8 mm and a wall thickness of between about 0.02 and 1 mm, or, preferably, between 0.1 and 0.4 mm. In a state in which the separation area is as close as possible to the upper end of the outer tube, the combination of the inner tube and the outer tube has a length of between about 10 and 30 cm.

Positioning a one-way valve in the through-slit of the plunger tube allows the creation of a dosing device that can be metered in the manner of a syringe, enabling the desired amount of composition to be drawn in via the free end of the plunger tube. In this process, the composition may in particular be mixed with the carrier medium. The inventive dosing device allows precise dosing of the composition whilst simultaneously providing simple means of adding a carrier medium which may for example be used for masking an unpleasant taste of the composition. The dosing path may in particular be marked with a scale on the plunger tube, thus ensuring precise dosing.

The one-way valve may be composed of rubber, silicone or a thermoplastic elastomer, each having a Shore hardness lower than 100 A. Examples of thermoplastic elastomers which may be used in the production of the one-way valve are cross-linked thermoplastic elastomers or thermoplastic elastomers based on styrene or elastomer-modified polypropylenes.

A one-way valve according to claim 19 guarantees positive flow and shut-off characteristics whilst providing a simple design.

A one-way valve according to claim 20 can be produced in a particularly cost-effective manner, for example by injection molding.

A valve arrangement according to claim 21 is particularly effective. In a shut-off direction, the two walls defining the through-slit are pressed together automatically. In the forward direction or flow direction, respectively, the slit may expand to form a through-opening of any desired size.

Such a one-way valve is also referred to as a spout valve. Instead of a spout valve, there may be also provided a lip valve, a shield valve or a valve having a slit diaphragm. Another alternative to the spout valve is a pressure-controlled diaphragm which breaks when first used and is therefore intended for single-use applications. Finally, a valve may be applied instead of the spout valve which is formed by a diaphragm that dissolves on contact with fluid. This final alternative is also designed for single use.

Wall thicknesses according claim 22 proved to be particularly suitable when used together with compositions and carrier media of typical viscosities and a one-way valve of typical materials.

The same applies to the slit lengths according to claim 23.

An integral connection according to claim 24 ensures a tight connection between the one-way valve and the plunger tube.

The advantages of a one-way valve according to claim 25 correspond to those described above with regard to the inventive dosing device.

BRIEF DESCRIPTION OF THE DRAWINGS

The figures show exemplary embodiments of the invention.

DETAILED DESCRIPTION OF THE DRAWINGS

Figure 1A:
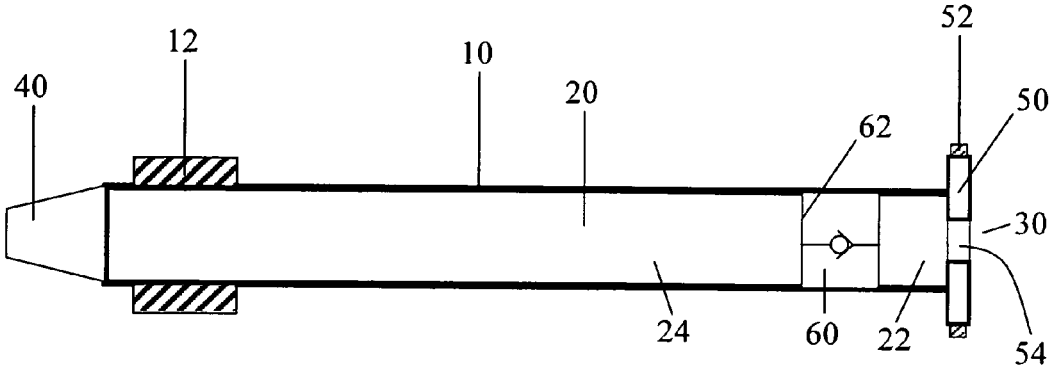
FIG. 1*a* shows an inner tube, a separation area and a selective connecting passage of a first embodiment of the invention.
Figure 1B:
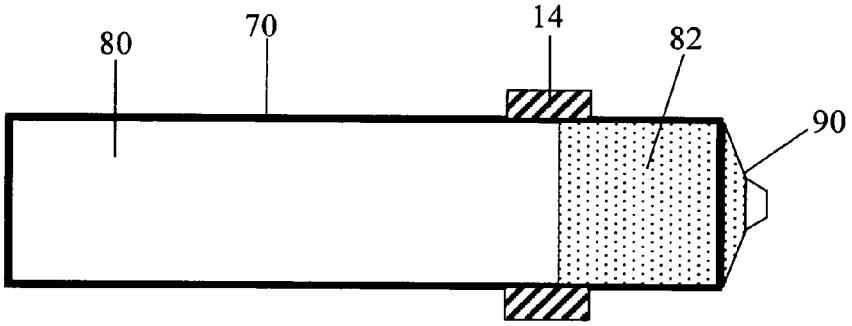
FIG. 1*b* shows the outer tube of the first embodiment of the invention.

FIG. 1*a* and FIG. 1*b* show two parts together forming a first embodiment of the invention.

FIG. 1*a* depicts the inner part of the first embodiment and comprising an inner tube 10 surrounding a first volume 20 as well as a separation area 30. A mouthpiece 40 is attached to one end of the inner tube, the lower end, while the opposite end, the upper end, is abutting to protrusions 50, 52 radially extending from the from the longitudinal axis of the inner tube. The protrusions comprise a first, rigid part 50 as well as a flexible sealing part 52 which is adapted to abut to the inner surface of the outer tube 70. In the inner tube 10, i.e. in the first volume 20, a selective connecting passage 60 is arranged which separates an upper part 22 of the first volume 20 from a lower part 24 of the first volume 20. Further, the rigid part 50 of the protrusions extend inwardly in a radial direction and forms a passage 54 connecting the upper part 22 of the first volume 22 with a cavity section 82 of the outer tube 70.

The inner tube further comprises a first grip section 12 which is formed by a ring arranged onto the outer surface of the inner tube 10. Instead of adding a ring to the inner tube, the outer surface of the inner tube can be manipulated to increase the friction and to enhance the handling, for example by adding irregularities to the outer surface of the inner tube form of grooves, pits or a thin layer of non-slip material.

The separation area 30 is formed of the protrusions 52, 50, the inner wall of the inner tube at the upper part of the first volume 22 and by the side of the selective connecting passage which faces towards the cavity section 82. In the embodiment shown in FIG. 1*a*, the separation area is continuous and is movable as a whole together with the inner tube.

FIG. 1*b* shows an outer tube 70 surrounding a second volume 80, a part of which is a cavity section 82. Preferably, the inner cross-section of the outer tube corresponds with the circumferential cross-section of the protrusions 50, 52 arranged at the inner tube 10. The outer tube further comprises an inlet opening 90 which is shown with two tapered sections.

In use, the substance containing the active agent is located in the cavity section 82 and is delimited by the circumferential inner surface of the outer tube at the cavity section, the inlet opening 90, the protrusions 52, 50 and the side of the selective connecting passage facing towards the cavity section as well as the inner surface of the inner tube 10 confining the upper part 22 of the first volume 20. Vacuum forces, surface tension, viscosity and cavity forces force the substance in the cavity section 82 not to leak out of the inlet opening 90 and therefore, the inlet opening 90 has a small diameter in comparison to the diameter of the outer tube.

The outer tube further comprises a second grip section 14 which is formed of a ring surrounding a part of the outer surface of the outer tube 70.

Figure 2:
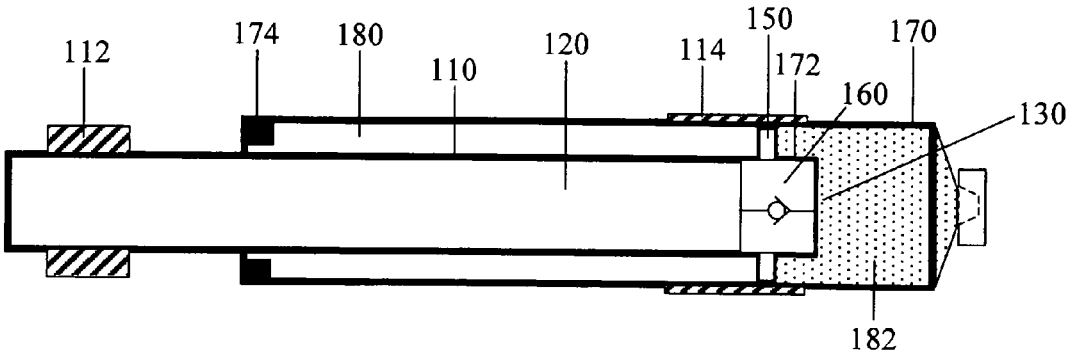
FIG. 2 shows a second embodiment of the device according to the invention.

FIG. 2 shows a second embodiment of the device of the invention, whereby equivalent elements have reference signs similar to the reference signs of FIGS. 1*a* and 1*b*.

The device shown in FIG. 2 comprises an inner tube 110 surrounding the first volume 120 in which a selective connecting passage 160 is arranged, formed of a flow control element as described above. Further, protrusions 150 radially extend from the outer surface of the inner tube towards the inner surface of an outer tube 170. The protrusions 150, together with the outer tube 170, provide a sealing, as it is known from syringes. The outer tube surrounds a second volume 180, a part of which forms a cavity section 182 adapted for enclosing a substance containing a drug. A second grip section 114 formed around the outer tube 170 comprises a thin layer of a non-slip material. The grip section 114 does not necessarily surround the complete outer tube but may extend only over a certain angle. This also holds for a first grip section 112, which may completely surround a part of the inner tube or may extend over the outer surface of the inner tube 110 only within a certain angle. In one embodiment, neither the first grip section 112 nor the second grip section 114 is continuous but be provided in certain angle sections only.

In comparison to the first embodiment shown in FIGS. 1*a* and 1*b*, the second embodiment shown in FIG. 2 shows a flow control element forming the selective connecting passage 160 which is abutting with the upper end of the inner tube. Therefore, the separation area 130 is formed of the side of the protrusions 150 facing towards the cavity section, by the side of the flow control elements facing towards the cavity section as well as a part 172 of the outer surface of the inner tube. The separation area is formed of two surface parts extending radially as well as of a part (a part of the inner tube 172) cylindrically extending along the longitudinal axis of the device. In another embodiment, which is not shown, the extension abuts with the upper end of the inner tube and therefore, the separation area is formed of the side of the extensions facing towards the cavity section as well as the sides of the selective connecting passage, i.e. the side of the flow control element facing towards the cavity section. In this way, the complete separation area extends radially and is smaller than the separation area 130 shown in FIG. 2.

The outer tube 170 comprises a stopper 174 extending inwardly from the outer tube in a radial direction, for limiting the distance the inner tube can be moved from the outer tube. The extension 150 touches the stopper 174 if the inner tube is pulled away from the outer tube and prevents the inner tube from falling off the outer tube. Further, the stopper 174 preferably has contact to the inner tube and acts as a guide for the inner tube when moved relative to the outer tube.

Figure 3:
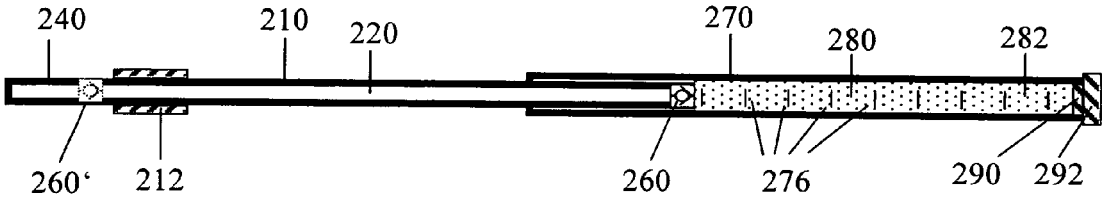
FIG. 3 shows a third embodiment of the device according to the invention.

FIG. 3 shows a third embodiment of the invention.

The device of FIG. 3 comprises an inner tube 210 which is partly inserted into and movable relative to an outer tube 270. The inner surface of the inner tube 210 defines a first volume 220, and the outer tube 270 defines with its inner surface a second volume 280. The second volume 280 comprises a cavity section 282 extending in the outer tube from the upper end of the inner tube to the upper end of the outer tube. A selective connecting passage 260 is formed of a flow control element, for example a non-return valve, and/or a valve enabling a flow if a certain pressure difference is exceeded. In the embodiment shown in FIG. 3, the flow control element is a pressure-breakable membrane. The side of the membrane facing towards the cavity section and therewith facing towards the substance, forms the separation area separating the cavity section from the first volume inside the inner tube 210. In order to prevent any leakage from the cavity section, a removable plug 292 seals the inlet opening 290. Further, a grip section 212 is provided near the lower end of the inner tube. Between the grip section 212 and the lower end of the inner tube, a section of the inner tube is provided forming a mouthpiece 240. In FIG. 3, an alternative position for the selective connecting passage 260' is shown in dotted lines, i.e. near the grip section 212 and/or the mouthpiece 240. This selective connecting passage is preferably provided by an actuatable flow control element. Due to the small distance to the grip section 212 and to the mouthpiece 240, the flow control elements can be actuated by pressing, pulling or rotating an actuation element manually or by applying a force using the mouth or the teeth. Further, the flow control element near the mouthpiece 240 or near the first grip section 212 can further have said characteristics of a non-return valve and/or a valve enabling a flow, only if a certain pressure difference threshold is exceeded or has been exceeded. A preferred embodiment of the invention has the aspect ratios shown in FIG. 3 and has an outer diameter of the outer tube of preferably 2 mm-15 mm, more preferably 3-10 mm, and in particular of approximately 4 mm-6 mm or of around 5 mm.

Marks 276 are located at the outer tube, for example by printing on the outer surface of the outer tube 270 or by applying a transparent or translucent label onto the outer tube containing the marks. The marks are used as level indicator indicating volume units of the substance contained in the cavity section 280. Additionally, some or each mark can have a symbol, e.g. an alphanumeric symbol pr a group thereof providing information related to the volume the respective mark is related to. Therefore, the outer tube is translucent or transparent at least at the section comprising the marks for optically providing the level of substance in the cavity section. As shown in FIG. 3, the marks are lines tangentially extending along a part of the cylindrical surface of the outer tube and are periodically and equidistantly repeated along the longitudinal axis of the outer tube 270.

The embodiments shown in FIGS. 1, 2 and 3, i.e. the first, second and third embodiment, are based on the first concept in which the selective connecting passage 60, 160, 260 provides a direct transfer of substance from the cavity section 80, 180, 280 to the first volume 20, 120, 220. Therefore, the embodiments shown in 1*a*, 1*b*, 2 and 3 comprise a selective connecting passage between the cavity section and the first volume, wherein the first volume acts as pressure compensation space. In this way, the pressure difference in the first, second and third embodiment is directly compensated between the cavity section and the first volume.

Figure 4:
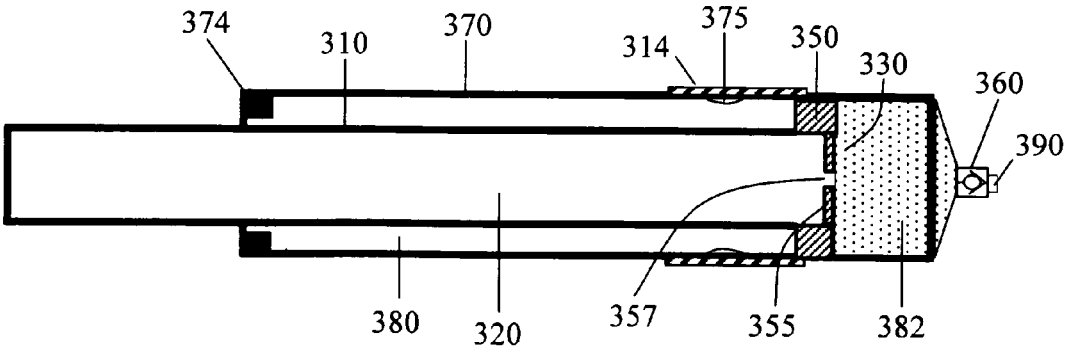
FIG. 4 shows a fourth embodiment of the device according to the invention.

In FIG. 4, the fourth embodiment of the invention is shown. As described in the following, the embodiment shown in FIG. 4 is based on the second concept according to which a selective connecting passage connects the cavity section with the surrounding space in a direct manner and the flow of substance from the cavity section to the first volume does not lead through a flow control element providing the selective connecting passage. Rather, the selective connecting passage allows pressure compensation of the cavity section with external fluids located in the surrounding space and indirectly enables the flow of substance from the cavity section into the first volume.

In FIG. 4, an embodiment according to the invention is shown comprising: An inner tube 310, an outer tube 370, a selective connecting passage 360 at an inlet opening 390 and a separation area 330 arranged at the end of the inner tube 310 facing towards the cavity section 380. The a separation area 330 is located at the upper end of the inner tube 310. The inner tube 310 contacts protrusions 350 which connect the outer surface of the inner tube with the inner surface of the outer tube 370. The protrusions 350 are movable relative to the inner surface of the outer tube 370 and, at the same time, provide a sealing with the outer tube 370 in the manner of a piston. Further, in order to prevent any unintentional leakage of substance from the cavity section 380 into the first volume 320 of the inner tube 310, inner protrusions 355 form a narrow passage 357. If low pressure is applied to the first volume 320, the narrow passage 357 allows a flow of substance from the cavity section 380 into the first volume 320.

Additionally, the fourth embodiment comprises a small smooth extension 375 of the outer tube 370 towards the inner tube 310. If the inner tube is pulled away from the outer tube and the extensions of the inner tube 350 are located at the extensions of the outer tube 375, a higher pulling force is necessary and thus a person pulling the inner tube from the outer tube feels a mark corresponding to a certain length of stroke of the inner tube 310. This may indicate a certain volume of the cavity section, for example a predefined volume corresponding to certain dose of active agent. Therefore, not only optical or visual marks can be used as shown in FIG. 3, but also tactile marks which can be felt when pulling the inner tube from the outer tube. Further, the outer tube comprises stoppers 374 defining a maximum lift of stroke and additionally act as guidance for the inner tube.

Figure 5:
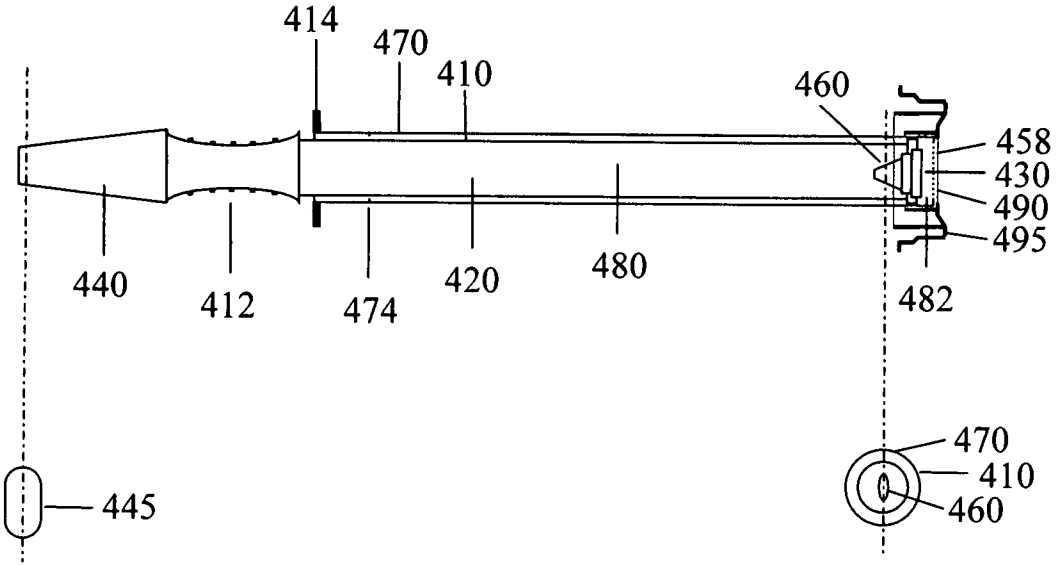
FIG. 5 shows a fifth embodiment of the device according to the invention.

FIG. 5 shows a fifth embodiment of the invention and depicts the best mode for carrying out the invention.

The fifth embodiment shown in FIG. 5 comprises an inner tube 410 defining a first volume 420 and an outer tube 470 defining a second volume 480, the second volume defining a cavity section 482. At one end of the inner tube 410 a first grip section 412 is arranged. The inner tube ends at a mouth piece 440 integrally formed with the inner tube. The mouth piece tapers from a circular towards an oval cross section with linearly reduced diameter starting from the side of the mouth piece abutting to a first grip section 412 towards a lower end of the mouth piece 440. The cross section 445 of the mouth piece 440 corresponds to the cross section at the dash and dot line at the left side.

At a lower end of the outer tube, stoppers 474 are extending radially towards the second volume. The stopper 474 is formed of a ring stops a movement of the inner tube 410 relative to the outer tube 470 when pulling the inner tube 410 from the outer tube 470. However, when applying a force above a certain threshold, the inner tube can be completely released from the outer tube, e.g. for cleaning the inner surface of the outer tube. Therefore, the stopper provides a tactile marc for a maximum stroke length.

A short elastic tube having a thin elastic walls and a cross section tapering towards the first and the second volume forms a selective connecting passage 460 between first and second volume. Further, the elastic tube integrally formed with a connecting element which provides shoulders. The shoulders of the connecting element fit into corresponding shoulders formed at the upper end of the inner tube 410. The elastic tube and the connecting element are formed of a thin layer of silicone. The selective connecting passage formed of an elastic, moveable tubular layer and provides a circular cross section at the end facing towards the upper end of the inner tube. The cross section is continually and linearly varied towards the lower end of the inner tube into an ovoid shape. If only the inherent elastic forces of the elastic tube are applied, a thin ovoid slit is formed at a port section, i.e. at the section of the selective connecting passage 460 extending towards the lower end of the inner tube and towards the mouth piece 440. Thus, if the pressure in the first volume is lower than the pressure in the cavity section, the port section opens and forms a passage with a nearly circular cross section. If the pressure in the first volume is higher than the pressure in the cavity section (e.g. when pulling the inner tube from the outer tube for filling the cavity section), the port section forms two nearly parallel walls which are pressed together by the pressure difference. In this event, any fluid flow between cavity section 482 and first volume 420 is blocked. Preferably, if no pressure difference is applied, the elastic forces of the selective connecting passage 460 form a small slit substantially forming a seal for the fluid located in the cavity section. In FIG. 5, the cross section of a flow control element forming the selective connection passage 460 is shown in a plane defined by the right dash and dot line.

The entire surface of the selective connecting passage facing towards the upper end of the outer tube forms a part of a separating area 430. At the upper end of the inner tube 410, the selective connecting passage 460 is attached to the inner tube. At the upper end of the inner tube 410, a circular bead or step sealingly connects the selective connecting passage 460 and the inner surface of the inner tube (defining the first volume 420) to the inner surface of the outer tube 470. The outer contour of the bead corresponds to the inner cross section of the outer tube. In this way, the inner tube and the selective connecting passage 460 sealingly abuts to the inner surface of the outer tube 470 and, at the same time, allows movements of the inner tube relative to the outer tube. In this way, the inner tube, together with the separating area 430, and the outer tube form a piston (inner tube, separating area) movable in a cylinder (outer tube).

At the upper end of the outer tube, i.e. at an inlet passage 490, a filter 458 is arranged. In FIG. 5, the filter is shown with dotted lines. The inlet passage has an inner cross section corresponding to the inner cross section of the outer tube. The filter 458 is formed as a grid to prevent larger particles from entering the device. Further, at the upper end of the outer tube, an adaptor 495 is arranged. The adaptor 495 is removable and is plugged onto the outer tube 470 by tight fit. The surface of the adaptor 495 facing away from the outer tube, i.e. a refilling opening, is matched to a complementary surface of a filling opening of a receptacle (not shown) containing an active substance or a drug. At lower end of the outer tube, a second grip section 414 is formed as a rim, which radially extends outwards from the second tube.

The fifth embodiment shown in FIG. 5 is drawn to scale. Therefore, the device according to the invention preferably has the proportions depicted in FIG. 5. The total length of the device depicted in FIG. 5 is 134 mm from the opening of the mouth piece to the refilling opening of the adaptor, the inner tube being at the right most position relative to the outer tube. Of course, any other suitable dimensions are possible, depending on the volume and/or viscosity of the substance contained in the cavity section. The strengths of the lines is not necessarily proportional to the respective wall thickness.

According to the best mode for carrying out the invention, the first and the second tube are formed of HDPE, the wall forming the inner tube being thinner than the wall forming the outer tube, the wall forming the inner tube having a thickness of 0.1 mm and the wall forming the outer tube having a thickness of 0.4 mm providing the outer tube with, a higher rigidity than the inner tube. The adaptor can be made of the material and can have the wall strength of the inner tube or of the outer tube or can have any other dimensions.

Preferably, the diameter of the outer tube is between 1 mm and 40 mm, advantageously between 3 mm and 15 mm and in particular preferably between 4 mm and 10 mm. The diameter of the inner tube is preferably between 1 min and 40 mm, between 3 mm and 25 mm and in particular preferably between 3 mm and 6 mm, provided that the diameter is smaller than the diameter of the outer tube. The volume of the cavity section is preferably between 1 ml and 200 ml, preferably between 2 ml and 100 ml and preferably between 5 ml and 50 ml. In a particular preferable group of embodiments, the volume is between 2 ml and 25 ml. The specification "between" is intended to relate to an interval comprising both, the upper as well as the lower border.

FIGS. 6 to 10 show a sixth embodiment of the invention, whereby equivalent elements have reference signs similar to the reference signs of FIGS. 1 to 5.

The sixth embodiment of FIGS. 6 to 10 also is a device for oral application of a substance and is referred to as a dosing device 5001.

Figure 8:
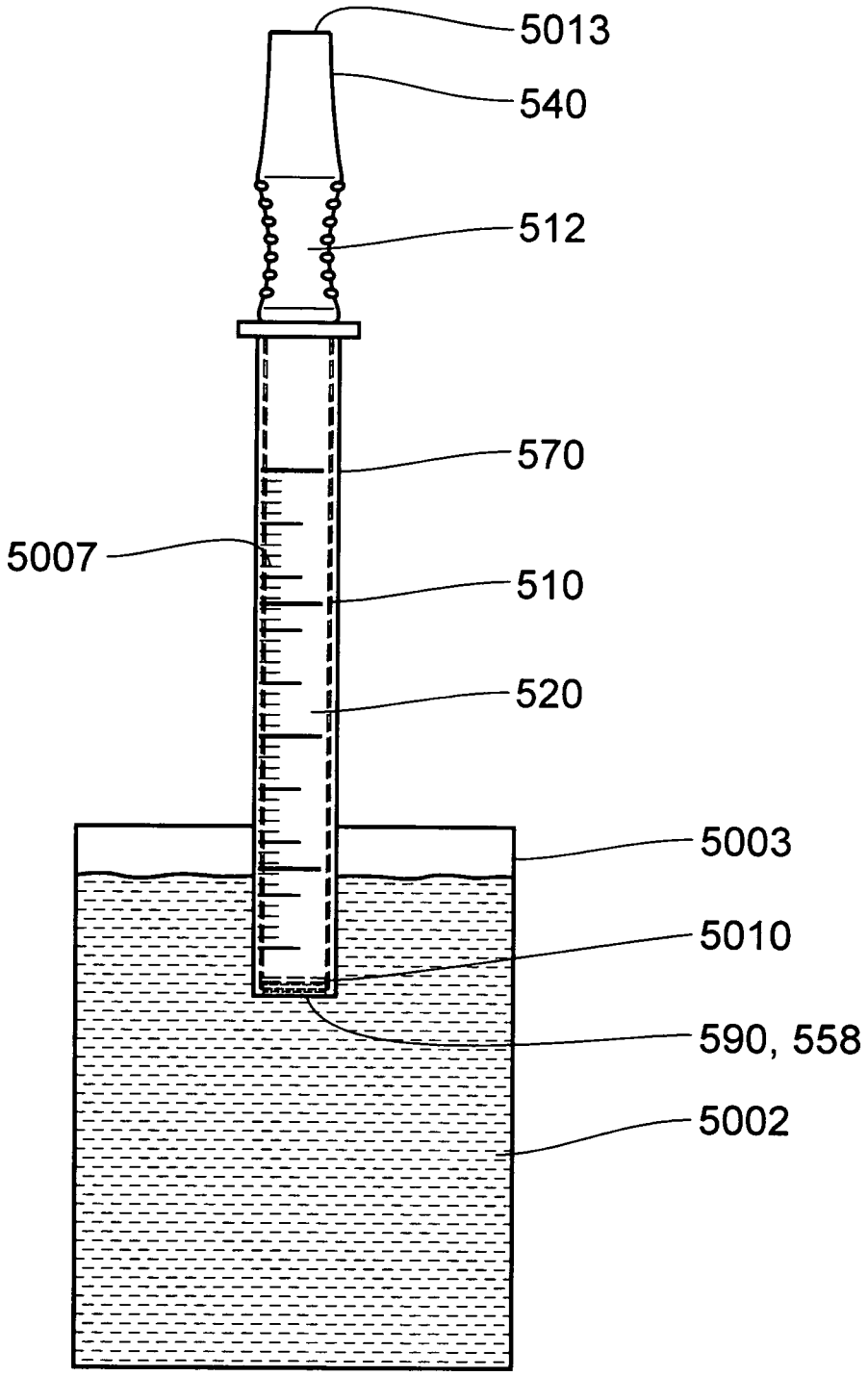
FIGS. 8 and 9 show current positions of the dosing device of FIG. 6 when a free-flowing composition is drawn in that is to be administered in doses.
Figure 9:
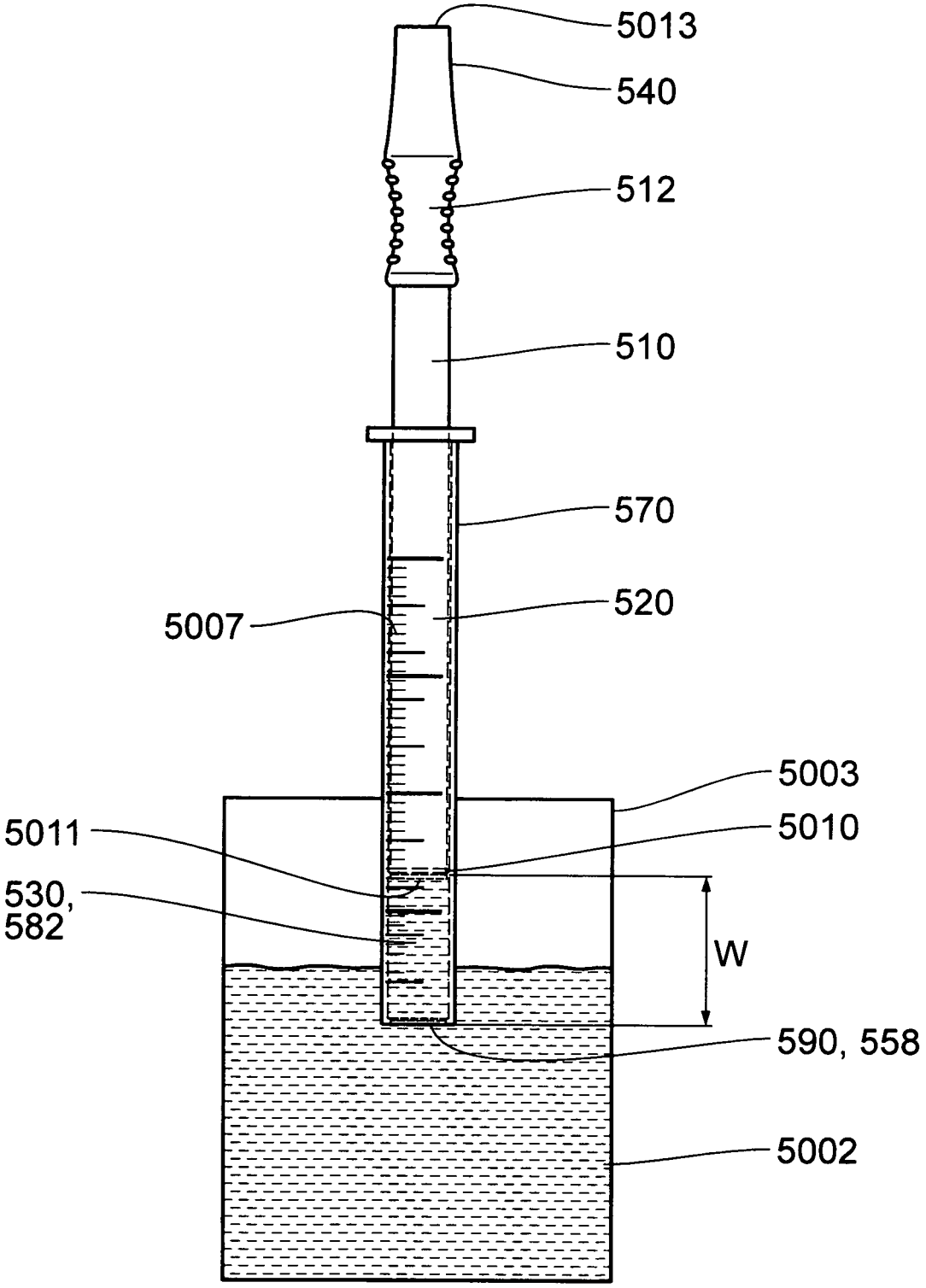

The dosing device 5001 is used to administer doses of a free-flowing composition 5002 which is provided in a composition storage receptacle 5003 shown in FIGS. 8 and 9. The storage receptacle 5003 contains the active substance or the drug which is to be applied orally. The dosing device 5001 serves to dispense the composition 5002 together with a free-flowing carrier medium 5004 that is provided in a carrier-medium storage receptacle 5005 shown in FIG. 10.

The dosing device 5001 has a hollow outer tube 570 of a translucent plastic material, said outer tube 570 being marked with a scale 5007. The outer tube 570 serves as a storage chamber for the composition and defines a second volume 580. The outer tube 570 has an inlet opening 590 at its lower end shown in FIGS. 6 and 8 to 10, a filter 558 having a small mesh size being disposed in said inlet opening 590. The inside of the outer tube 570 communicates with the surroundings via the inlet opening 590.

A plunger tube 510 is disposed as an inner tube in the outer tube 570. The plunger tube 510 is also made of plastics. The plunger tube 510 has a circumferential bead 5010 at its end facing the inlet opening 590 in the outer tube 570, said circumferential bead 5010 sealing the plunger tube 510 against an inner wall of the outer tube 570.

Figure 6:
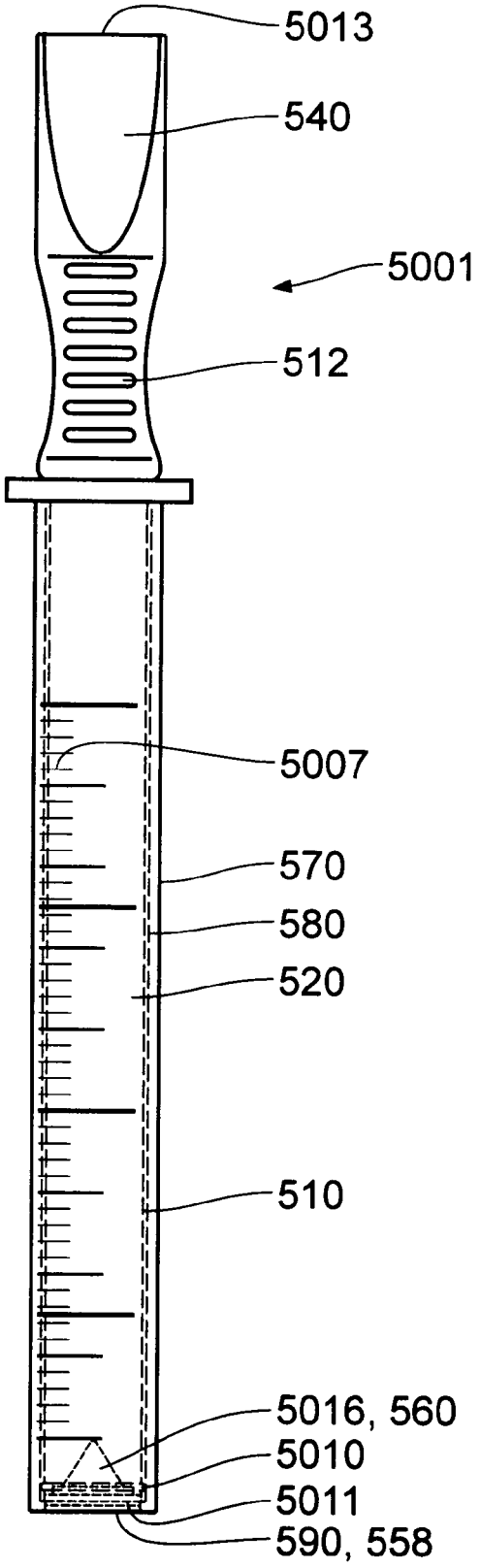
FIG. 6 shows a side view of a dosing device being a sixth embodiment according to the invention, wherein non-visible internal components are shown dashed.
Figure 10:
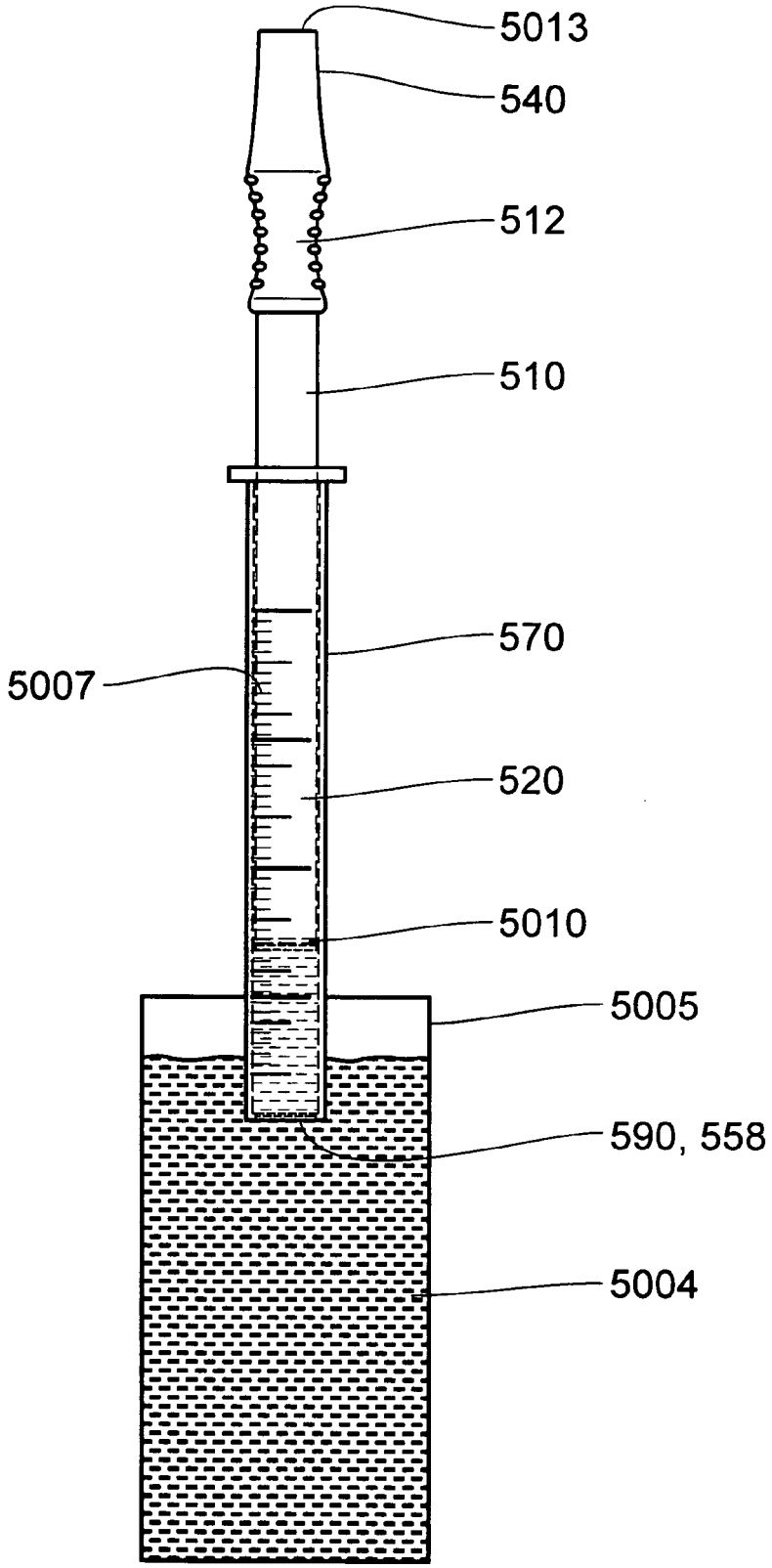
FIG. 10 shows a current position of the dosing device of FIG. 6 when the composition is dispensed together with a free-flowing carrier medium.

The plunger tube 510 is displaceable between a rest position shown in FIGS. 6 and 8 and a dosing position shown in FIGS. 9 and 10. In the rest position, the plunger tube 510 is completely inserted in the outer tube 570. In the dosing position, the plunger tube 510 is removed from the outer tube 570 along a path W (cf. FIG. 9) that corresponds to the desired amount of composition 5002 to be dispensed.

The plunger tube 510 has a substantially hollow cylindrical shape and opens a fluid connection between a through-opening 5011 that is disposed between the outer tube 570 and an inside 520, i.e. a first volume, of the plunger tube 510 and a suction opening 5013 that is disposed at a free end of the plunger tube 510, said free end projecting out of the outer tube 570. This free end is a mouthpiece 540 disposed between the suction opening 5013 and a grip section 512 of the plunger tube 510. A cross section of the suction opening 5013 corresponds to the cross section 445 of the fifth embodiment of FIG. 5.

Figure 7:
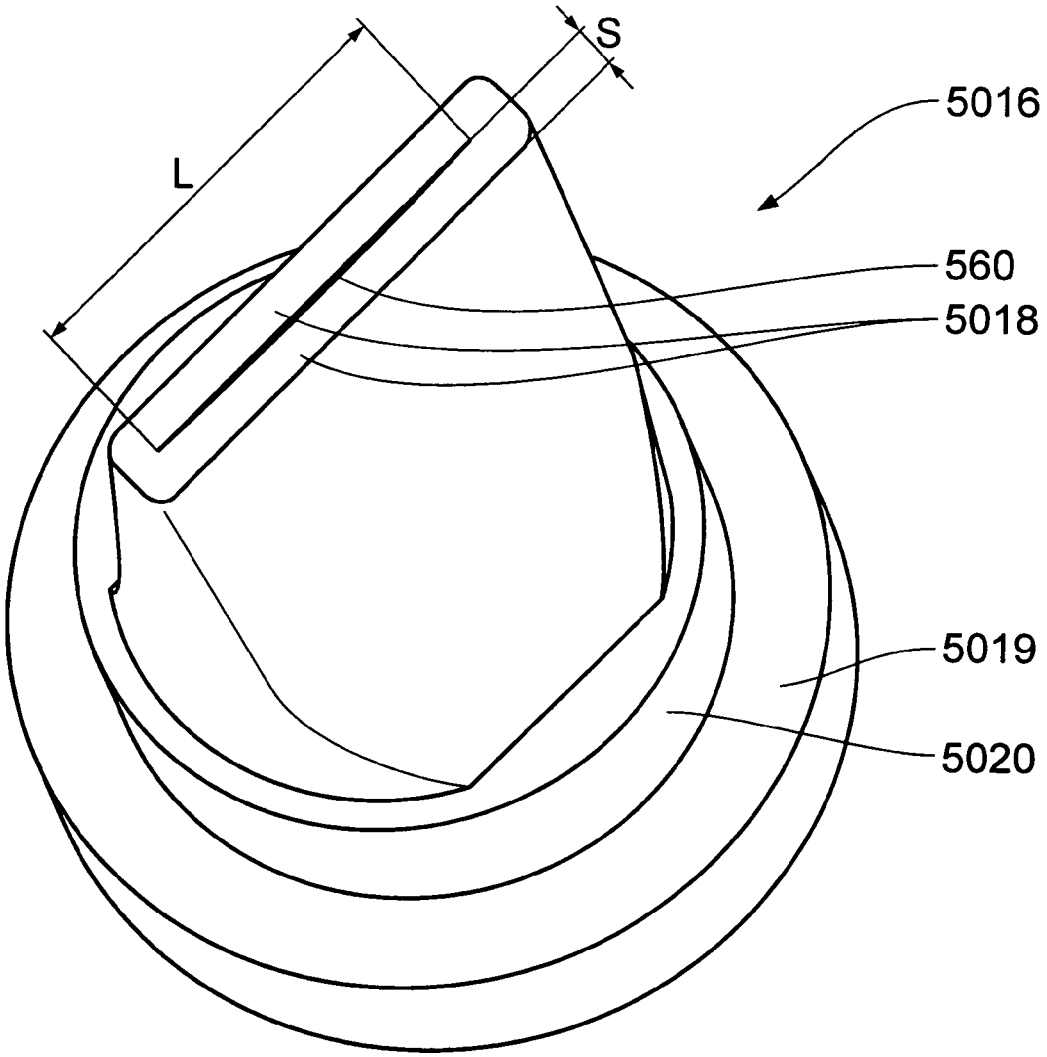
FIG. 7 shows a perspective, greatly enlarged view of a one-way valve of the dosing device according to FIG. 6.

A one-way valve 5016 is disposed in the through-opening 5011 of the plunger tube 510, said one-way valve 5016 being shown enlarged in FIG. 7. The one-way valve 5016 opens a fluid path from the outer tube 570 into the inside 520 of the plunger tube 510 and shuts off said fluid path in the opposite direction, i.e. from the inside 520 of the plunger tube 510 into the outer tube 570.

The one-way valve 5016 is a spout valve made of an elastic plastic material. The one-way valve 5016 is designed as one piece and is made of silicone rubber. The one-way valve 5016 has a through-slit 560 serving as a connecting passage between two elastic walls 5018 that bear against one another whilst forming a defined angle between each other. The walls 5018 have a wall thickness of 0.45 mm.

Other wall thicknesses between 0.3 and 0.6 mm are also allowable, in particular between 0.4 and 0.5 mm.

The through-slit 560 has a length L of 3.5 mm. Other lengths between 2 and 5 mm, in particular between 3 and 4 mm, are also allowable.

The one-way valve 5016 has an annular connecting section 5019 comprising a circumferential shoulder or a circumferential step 5020. This circumferential shoulder 5020 is complementary with the inner edge of the through-opening 5011 of the plunger tube 510 to which the one-way valve 5016 is integrally connected, in particular by gluing or welding. Alternatively, the one-way valve 5016 may also be firmly held in place or clamped in the through-opening 5011 of the plunger tube 510 by mechanical means.

The dosing device 5001 is applied as follows:

The dosing device 5001 is at first in its rest position shown for example in FIG. 8, wherein the plunger tube 510 is completely inserted. In this rest position, the end of the dosing device 5001 comprising the inlet opening 590 is immersed into the composition storage receptacle 5003, as shown in FIG. 8. In this immersed position, the plunger tube 510 is removed from the outer tube 570 in the manner of a syringe plunger. This creates a low pressure in a storage chamber that is disposed below the circumferential bead 5010 on the inside of the outer tube 570 next to the inlet opening 590. This storage chamber serves the functions of the cavity section 582 and of the separating area 530 of the embodiments described above. Air is in particular prevented from flowing from the inside 520 of the plunger tube 510 into the storage chamber 530, 582 due to this fluid path being shut off by the one-way valve 5016. The composition 5002 is drawn into the storage chamber 530, 582 due to the low pressure that is created in the storage chamber 530, 582. The amount of composition 5002 drawn into the storage chamber 530, 582 can be taken from the scale 5007.

Dosing of the composition 5002 by means of the dosing device 5001 is complete as soon as there is a sufficient amount of composition 5002 in the storage chamber 530, 582. When in the dosing position shown in FIG. 9, the dosing device 50011 may now be immersed into the carrier-medium storage receptacle 5005. Subsequently, the user puts the mouthpiece 540 in his mouth and sucks on it as if it were a drinking straw. This creates a low pressure on the inside 520 of the plunger tube 510, allowing the composition 5002 to be at first drawn out of the storage chamber 530, 582 and, through a pressure compensation space, into the inside 520 of the plunger tube 510. Due to the fact that the storage chamber 530, 582 is fluidically connected to the carrier medium 5004 via the inlet opening 590, the carrier medium 5004 is subsequently also drawn into the storage chamber 530, 582 via the inlet opening 590, and into the inside 520 of the plunger tube 510 via the storage chamber 530, 582. When composition 5002 and carrier medium 5004 pass into the inside 520 of the plunger tube 510 via the through-opening 5011, the one-way valve 5016 acts in the forward or flow direction. The composition 5002 then mixes with the carrier medium 5004 on the inside 520 of the plunger tube 510. Thus, the user ingests a mixture of composition 5002 and carrier medium 5004 via the suction opening 5013.

Depending on the dosage of the composition 5002, this mixture may be a composition 5002 that is more or less diluted with carrier medium 5004. An appropriate flavor of the carrier medium 5004 therefore allows to mask in particular an unpleasant taste of the composition 5002. At the same time, the dosing device 5001 ensures precise dosing of the composition 5002.

The invention claimed is:

1. A dosing device for administering doses of a free-flowing composition together with a free-flowing carrier medium, comprising:

a storage chamber for the composition, said storage chamber communicating with a surroundings via at least one inlet opening;

a plunger tube that is disposed in the storage chamber for sealed displacement between a rest position in which the plunger tube is completely inserted in the storage chamber, and a dosing position in which the plunger tube is removed from the storage chamber along a path that corresponds to a desired amount of the composition to be dispensed, wherein the plunger tube is hollow and opens a fluid connection between a through-opening arranged between the storage chamber and an inside of the plunger tube; and a suction opening disposed at a free end of the plunger tube, said free end projecting out of the storage chamber, wherein a one-way valve is disposed in the through-opening, the one-way valve opening a fluid path from the storage chamber into the inside of the plunger tube and shuts off said fluid path in the opposite direction, and wherein moving the plunger from the rest position to the dosing position provides a pressure in the storage chamber which is lower than a pressure of the surroundings so that the free-flowing composition present in the surroundings flows through the inlet and into the storage chamber, and the free-flowing composition in the storage chamber can be dosed through the fluid connection and suction opening.

2. The dosing device according to claim 1, wherein the one-way valve is composed of an elastic plastic material.

3. The dosing device according to claim 2, wherein the one-way valve is unitary.

4. The dosing device according to claim 2, wherein the one-way valve has a through-slit between two elastic walls that bear against one another whilst forming a defined angle between each other.

5. The dosing device according to claim 4, wherein the elastic walls have a thickness of between 0.3 and 0.6 mm.

6. The dosing device according to claim 4, wherein the through-slit has a length of between 2 and 5 mm.

7. The dosing device according to claim 1, wherein the one-way valve is integrally connected to the plunger tube.

* * * * *